United States Patent [19]

Federico

[11] Patent Number: 4,763,759

[45] Date of Patent: Aug. 16, 1988

[54] APPARATUS FOR LUBRICATING WHEEL FLANGES OF A RAILROAD VEHICLE

[75] Inventor: Ennio Federico, Sao Paulo, Brazil

[73] Assignee: Eximport Industria E Comercio Ltda., Sao Paulo, Brazil

[21] Appl. No.: 46,669

[22] Filed: May 4, 1987

[51] Int. Cl.[4] ..... B61K 3/02

[52] U.S. Cl. ..... 184/3.2; 239/592

[58] Field of Search ..... 184/3.1, 3.2, 6.26, 184/15.2, 15.3, 55.2; 239/601, 592, 597, 599

[56] References Cited

U.S. PATENT DOCUMENTS

| | | | |
|---|---|---|---|
| Re. 12,209 | 3/1904 | Hawkins | 184/3.2 |
| 2,985,386 | 5/1961 | Steinen | 239/597 |
| 3,191,718 | 6/1965 | Haywood | 184/6.26 X |
| 3,666,049 | 5/1972 | Kern et al. | 184/6.26 X |
| 3,834,493 | 9/1974 | Hubert | 184/6.26 X |

*Primary Examiner*—Leonard E. Smith

[57] ABSTRACT

Lubricating equipment for wheel flanges of a railroad vehicle has a compressed air supply, and a generator (3) generating an air-oil mixture. Tubing extends from the generator to application nozzles (15) which have a profile that increases density of the air-oil mixture as well as the speed of the flow. The equipment releases oil in a micro-pulverized form onto the surface so that it is unaffected by air turbulence in the vicinity of the moving wheels.

1 Claim, 3 Drawing Sheets

APPARATUS FOR LUBRICATING WHEEL FLANGES OF A RAILROAD VEHICLE

The present patent relates to an improvement in lubricating equipment of the so-called oil-mist type, which improvement is intended to adapt such equipment for lubrication of railroad vehicle wheel flanges.

Conventional equipment performing this task is normally installed on the permanent track or in the car itself, where the latter usually employs grease, oil or solid graphite as a lubricating agent.

Thus, the equipment using grease is basically comprised by a piston pump, reservoir, directional valve, tachogenerator, control panel, air lines, lubricant lines, atomizers and other appurtenances.

The equipment thus constructed operates when the control panel thereof receives tachogenerator signals after each revolution of the wheels and converts these pulses into distances. An adjustable selector determines the intermittence of the lubricating cycles based, therefore, on distances travelled, at the end of which the pump is actuated and pressurized grease is delivered through a suitable line to the atomizers located at a short distance from some of the wheels. Simultaneous opening of a solenoid valve, also controlled by the panel, causes compressed air to be admitted to the air line which, in a like manner, converges to the atomizers. Thus, the air-and-grease mixture causes the latter to be atomized and to be sprayed onto the wheel flange, with the excess being transferred to the tracks to the point where new atomization occurs, and so on.

On the other hand, items of equipment using lubricant oil have practically the same components and operate in a similar manner, either by the distance travelled or, sometimes, by the time interval. A variant of this equipment operates with a disk in permanent contact with the wheel, whose rotating axle, after reduction by a gear train, causes operation of a small piston pump, receiving oil from a reservoir. The oil pressurized by the pump returns through the same path to the center of the disk (which is built to be split in a lengthwise direction) and by centrifugal action the oil passes from the disk to the wheel flange, with a multiposition selector switch being provided to regulate oil volume.

Finally, solid lubricant equipment is simply comprised by spring-loaded devices that maintain graphite rods in permanent contact with the wheel flanges, so that, as the supply is consumed, the springs extend to maintain a permanent contact force.

Although such equipment is widely used, all of its examples exhibit a number of inconveniences which reduce their efficiency and sometimes cause them to be economically unfeasible. Such inconveniences are due to constructive complexities, where high numbers of components are involved, the majority with movable parts subject to wear; to waste of lubricant, applied in volumes far beyond those required for each operating cycle, with the major part being centrifuged away by the wheels; to the lack of safety that excess lubricant can impart to the actual travel of a train, seeing that the centrifuged portion of the lubricant may eventually reach the contact surfaces of the rails or wheels, causing serious braking problems due to lack of adherence; and, finally, to high solid lubricant consumption, which makes this alternative altogether unfeasible for wheels revolving at very high speeds.

Therefore, in the light of such problems and for the purpose of overcoming them, existing industrial lubricating equipment has been researched to disclose such items most closely suited to flange lubrication and doing away at the same time with the aforementioned problems, the oil-mist lubricating system having finally being selected for its utterly simple construction, which does not call for moving parts or those subject to wear, and due to its capacity to supply atomized oil at extremely low volumes.

This equipment, as conventionally built, is provided with a basic element, called a "mist generator", made to operate by compressed air passing through a venturi tube available on the inside, the oil from a reservoir, mounted under the generating head, being siphoned into the air line in the form of droplets, which in turn are transformed into very fine particles (2-micrometer diameter). Such rarefied particles remain in suspension and are conveyed to application points through the air line. At the application points, fittings, called "reclassifiers", cause these small oil particles to combine, forming larger particles that are finally impinged upon the surface to be lubricated.

During conventional operation of this system, the oil is applied to the surface to be lubricated in the form of a mist and the atomization pressure is low, as is the oil outlet velocity at the nozzles, thus making it impossible for lubricant to be applied to members at a certain distance from the nozzles, especially when such members are moving at high speed and, consequently, generating some turbulence in the air, so that the oil mist is dispersed.

Therefore, for application of this lubricating system to fast-moving wheel flanges, some changes should be introduced, for example, to increase the low outlet pressure of the mist and, to obtain, instead of mist, a more concentrated form of microatomization, since the location of the application point is clearly defined.

To attain such objects, firstly, a new operating rate has been provided for the equipment, in addition to having its oil-conveying lines provided with drains, and, furthermore, a new oil-emitting spout has been developed, with the usual passage area but having a suitable profile for conversion of the mist into very fine oil particles, which are then sprayed onto the surface to be lubricated without risk of the dispersion caused by turbulence generated by the moving wheels.

For a more adequate visualization of construction of the lubricating equipment as described in the present invention, three sheets with drawings are annexed, in which.

Figure 1:
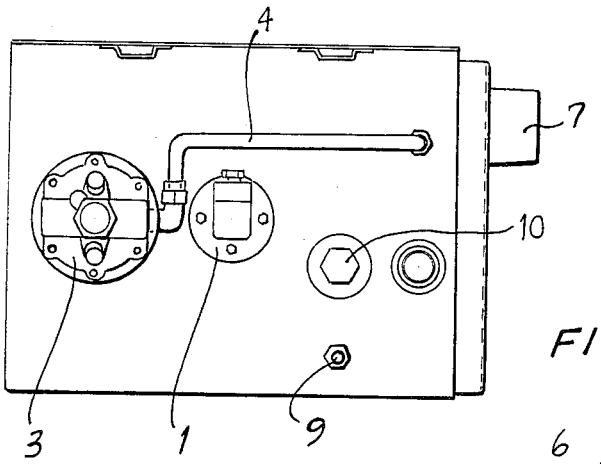
FIG. 1 illustrates the oil tank from an upper view.
Figure 2:
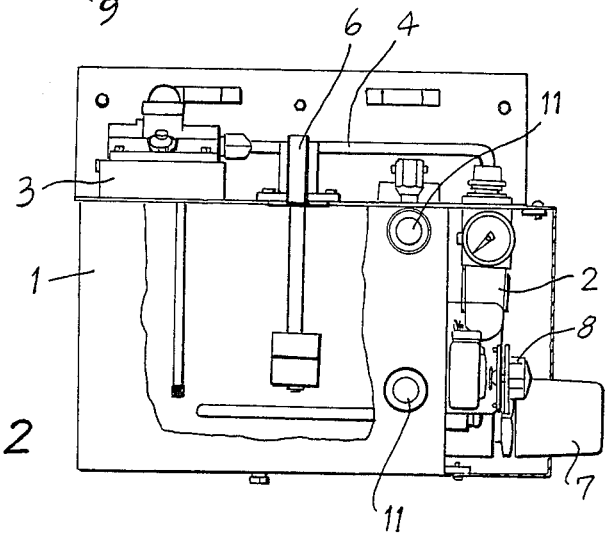
FIG. 2 illustrates the above tank from a side view with a partial cross section for more adequate understanding.
Figure 3:
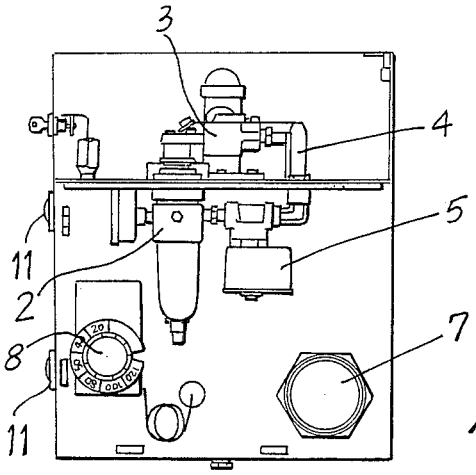
FIG. 3 illustrates a top view of said tank.
Figures 4A, 4B:
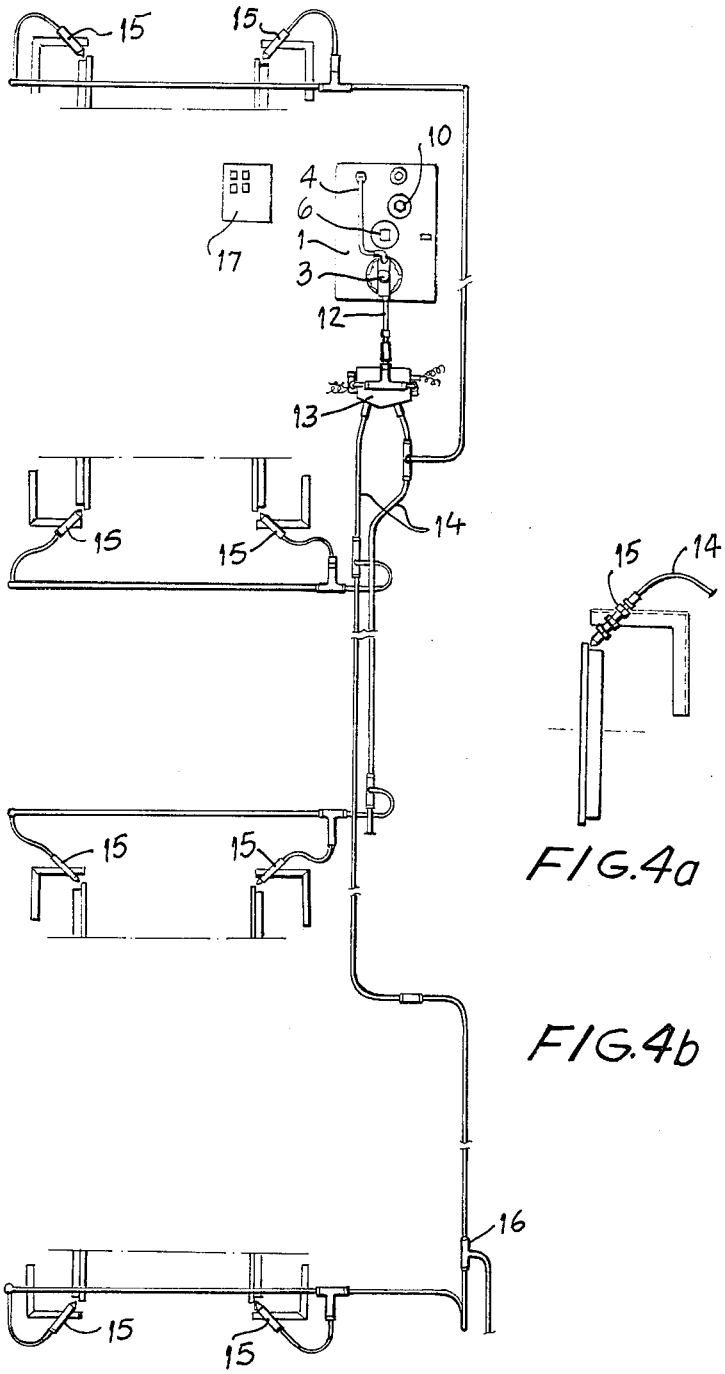
FIG. 4 illustrates a general schematic of the lubricating equipment.
Figure 5A:
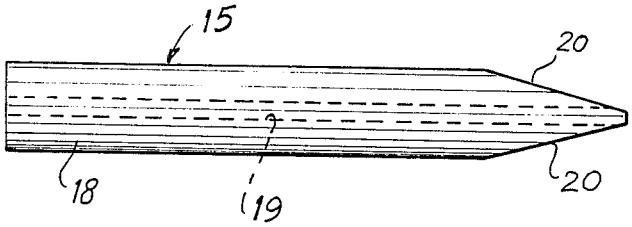
Figure 5B:
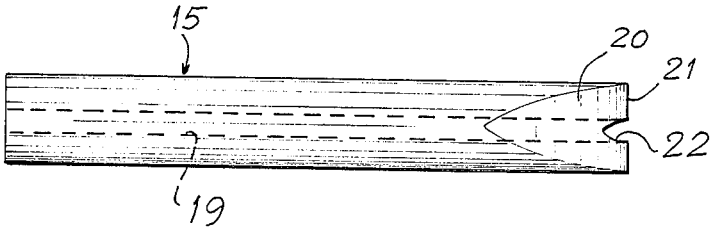

FIG. 4*a* shows an enlarged scale of a portion of FIG. 4;

FIG. 5*a* and 5*b* respectively, are a top and side view of the oil-emitting spout.

According to illustrations in the aforementioned figures, the equipment covered by the present invention is essentially comprised by a lubricant oil reservoir 1, whereon a regulator filter 2 is firstly seated, whose one side is connected to the compressed air supply means (not illustrated) and other side to a generator 3, through a pipe 4, in which a solenoid valve 5 is interposed.

Included in said reservoir 1, provision is further made for a level switch 6, an oil heater 7, the latter being controlled by a thermostat 8, relief valve 9, filler plug 10, level-viewing devices 11 and others.

Extending from said generator 3, a main tubing 12 is provided, connected to an air valve 13, from which secondary tubings 14 extend, on whose extremities application nozzles 15 are disposed, directed toward wheel flanges to be lubricated, with drains 16 being provided, interposed in the referenced secondary tubings 14.

Finally, the equipment is further provided with a panel 17, installed in the locomotive cab, having a button for manual actuation (assembly, test and others) and signaling lamps for power, operation and low-level indication.

The aforementioned application nozzles 15 are comprised by a tubular body 18, with a relatively narrow axial conduit 19, whose oil-emitting extremity is provided with opposite chamfers 20, giving it a wedge-shaped appearance, wherein, at the medial point of the transverse edge 21, formed between said chamfers 20, the conduit 19 opens, with a substantially V-shaped recess 22 being provided at this same point, having the wider section at the level of edge 21 and length equal to the diameter of said conduit 19.

Equipment thus constructed is naturally subject to slight variations, so as to suit different models of locomotives and the like, and operates according to the description below.

The system is made to operate by the solenoid valve 5, the opening of which occurs due to a command from the locomotive's speed controller, from position 1.

Accordingly, compressed air passes first through the regulator filter 2 and thence to the generator 3, where a pressure differential is created, which causes the oil to flow from the reservoir to a viewing device provided on the generator, and therefrom again to the air flow. This displacement forms a high-density, vaporized air-and-oil mixture, which fills the upper portion of the reservoir, above the surface of the oil. This oil in suspension is then conveyed to application points through main tubing 12 and secondary tubings 14.

At these application points, the nozzles 15 increase the density of the mixture and speed up flow velocity so that it is sprayed onto the surface to be lubricated.

The directional air valve 13 operates by command of the locomotive itself, alternates the flow to the leading wheels of each truck, according to the direction of movement.

Oil temperature is maintained constant, even when variations occur in the ambient temperature, by the heater 7, the setting of whose thermostat 8 is specific for the oil to be employed, an interlock being provided, for the sake of safety, between the heater 7 and the level switch 11, which disconnects the resistance in the event of oil shortage.

Finally, the drains 16 help to eliminate oil condensing along the secondary tubings 14 and are built so as not to affect the required pressure in the

What is claimed:

1. An apparatus for lubricating moving wheel flanges of a railroad vehicle, comprising: an oil reservoir, a source of compressed air, generator means connected to said reservoir and said source for generating a high-density air-oil mixture, nozzles in the vincinity of said wheel flanges respectively, and tubing extending from said generator means to said nozzles, each nozzle being tubular with a narrow axial conduit having one end communicating with said tubing and another end for emitting oil onto the respective wheel flange, said another end being defined by opposite chamfers forming a wedge with an edge such that said conduit has a V-shaped recess emitting a concentrated jet of circular cross section of high velocity atomized oil particles onto the respective wheel flange, unaffected by air turbulence caused by the moving wheel flanges.

* * * * *